US006116919A

United States Patent [19]

Tung

[11] Patent Number: 6,116,919

[45] Date of Patent: Sep. 12, 2000

[54] ELECTRICAL CARD CONNECTOR

[75] Inventor: Shun-Chi Tung, Tu-Chen, Taiwan

[73] Assignee: Hon Hai Aprecisionind. Co., Ltd., Taipei Hsien, Taiwan

[21] Appl. No.: 09/357,461

[22] Filed: Jul. 20, 1999

[30] Foreign Application Priority Data

Dec. 31, 1998 [TW] Taiwan ..... 87222061

[51] Int. Cl.[7] ..... H01R 12/20

[52] U.S. Cl. ..... 439/79

[58] Field of Search ..... 439/79, 64, 541.5

[56] References Cited

U.S. PATENT DOCUMENTS 5,252,080 10/1993 Pesson ..... 439/79
5,340,320 8/1994 Puerner ..... 439/79
5,346,404 9/1994 Shimada ..... 439/79
5,639,250 6/1997 Neef et al. ..... 439/79
5,688,129 10/1993 Flaherty ..... 439/79

*Primary Examiner*—Gary F. Paumen
*Attorney, Agent, or Firm*—We Te Chung

[57] ABSTRACT

An electrical card connector comprises a main body and a spacer attached to the main body. The main body defines a pair of receiving portions and a number of terminals between the receiving portions. Each receiving portion forms a notch in an inner surface thereof. The spacer includes a horizontal board and a vertical board connecting with one edge of the horizontal board. A pair of latches extend from opposite ends of an inner surface of the vertical board for engaging with the notches of the main body. A number of passageways are defined between the latches for receiving the terminals of the main body.

1 Claim, 4 Drawing Sheets

ELECTRICAL CARD CONNECTOR

BACKGROUND OF THE INVENTION

1. Field of the Invention

The present invention relates to an electrical card connector, and particularly to an electrical card connector having a spacer securely mounted thereto.

2. Description of Prior Art

Existing electrical card connectors generally have a number of compactly aligned terminals extending through a header thereof. Each terminal has a terminating tail for being inserted into a predetermined hole of a printed circuit board or a transition board to implement an electrical connection. Thus, it is desired to ensure an accurate alignment of the terminals for facilitating insertion of the terminals into the predetermined holes. Furthermore, when being inserted into the corresponding predetermined holes, the terminals are subjected to a resisting force. Thus, it is also desired that the electrical card connector provide a supporting device to withstand the resistive force exerted on the terminals thereby preventing the terminals from deforming.

SUMMARY OF THE INVENTION

Accordingly, an object of the present invention is to provide a spacer for an electrical card connector, which will assure an accurate alignment of the terminals.

Accordingly, another object of the present invention is to provide a spacer for an electrical card connector, which will withstand a resistive force exerted on the terminals, and thereby prevent the terminals from deforming.

In a preferred embodiment of the present invention, an electrical card connector comprises a main body and a spacer attached to the main body. The main body defines a pair of receiving portions and a plurality of terminals between the receiving portions. Each receiving portion forms a notch in an inner surface thereof. The spacer includes a horizontal board and a vertical board connecting with one edge of the horizontal board. A pair of latches extend from opposite ends of an inner surface of the vertical board for engaging with the notches of the main body. A plurality of passageways is defined between the latches for receiving the terminals of the main body.

BRIEF DESCRIPTION OF THE DRAWINGS

Other objects and advantages of the present invention will be understood from the following description of an electrical card connector according to a preferred embodiment of the present invention shown in the accompanying drawings, in which.

DETAILED DESCRIPTION OF THE PREFERRED EMBODIMENT

Figure 1:
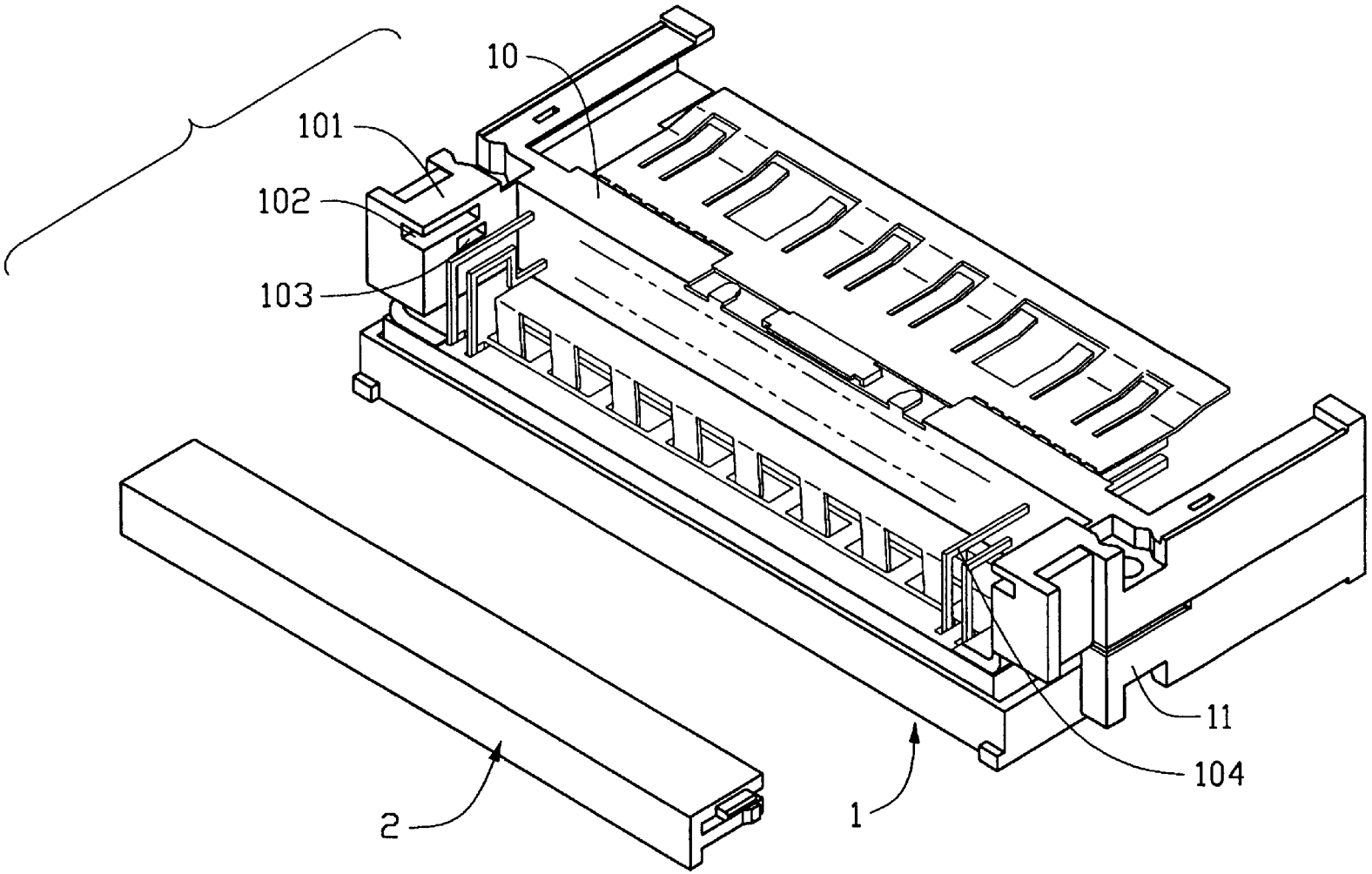
FIG. 1 is a perspective view of an electrical card connector and a spacer separated therefrom embodying the concepts of the present invention.

FIG. 1 shows an electrical card connector in accordance with the present invention comprising a main body 1 and a spacer 2 mounted to the main body 1. The main body 1 includes a top header 10 and a lower header 11 stacked together. The top header 10 defines a pair of receiving portions 101 at opposite ends thereof. Each receiving portion 101 defines a slot 102 and a notch 103 adjacent to the slot 102 in an inner surface thereof. A number of terminals 104 extend through the top header 10 between the receiving portions 101. Portions of the terminals 104 received in the top header 10 are aligned in two rows and portions of the terminals 104 between the pair of slots 102 are aligned in one row.

Figure 2:
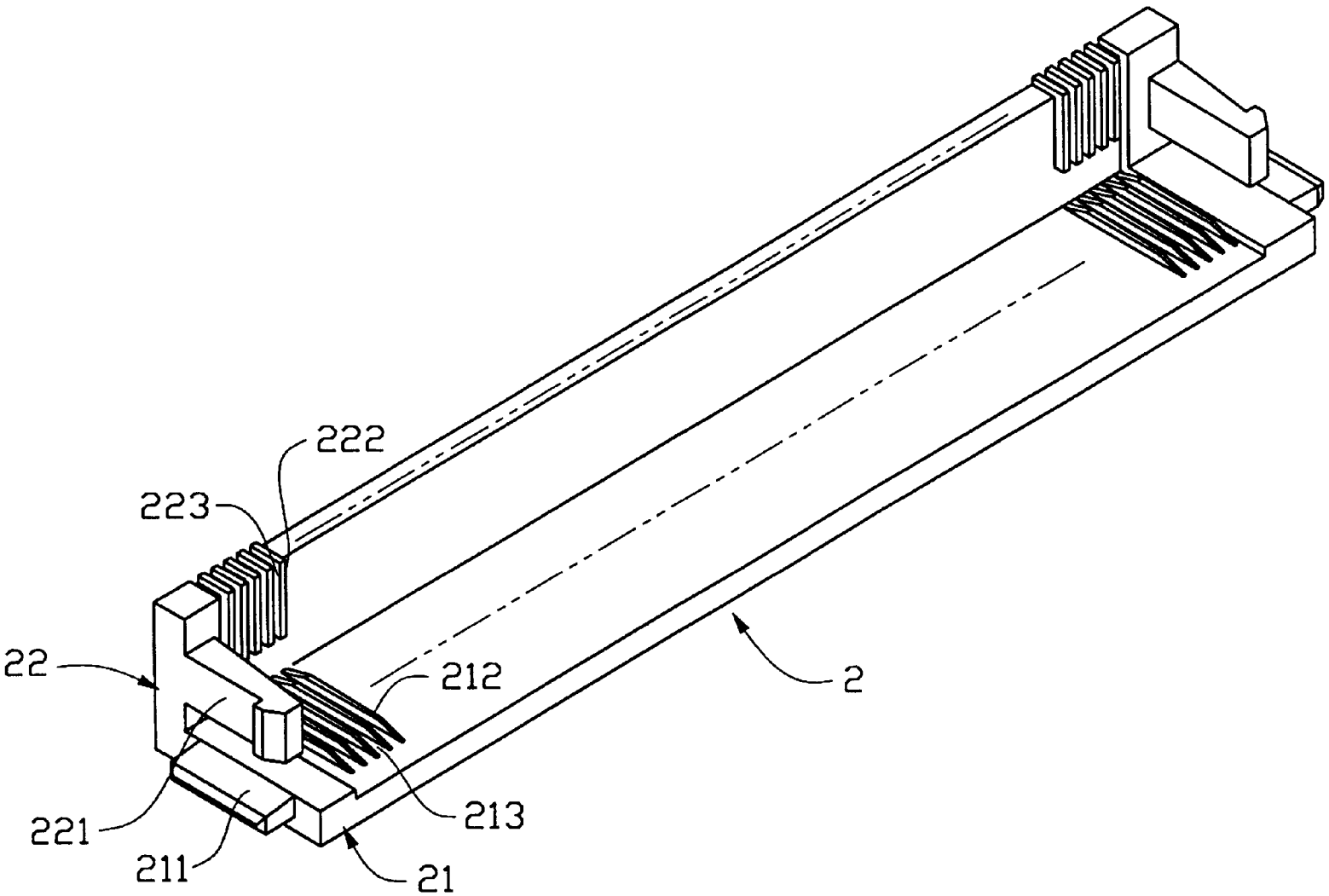
FIG. 2 is a perspective view of the spacer.

Referring to FIG. 2, the spacer 2 includes a horizontal board 21 and a vertical board 22 connected to one edge of the horizontal board 21. The horizontal board 21 forms a pair of inserting blocks 211 on opposite ends thereof for being inserted into the slots 102 of the top header 10. A pair of latches 221 extend from opposite ends of the vertical board 22 for engaging with the corresponding notches 103 of the top header 10. The boards 21, 22 each form a plurality of partitions 212, 222 on an inner surface thereof between the latches 221. Aligned pairs of planar passageways 213, 223 are defined between the partitions 212, 222 for receiving the terminals 104.

Figure 3:
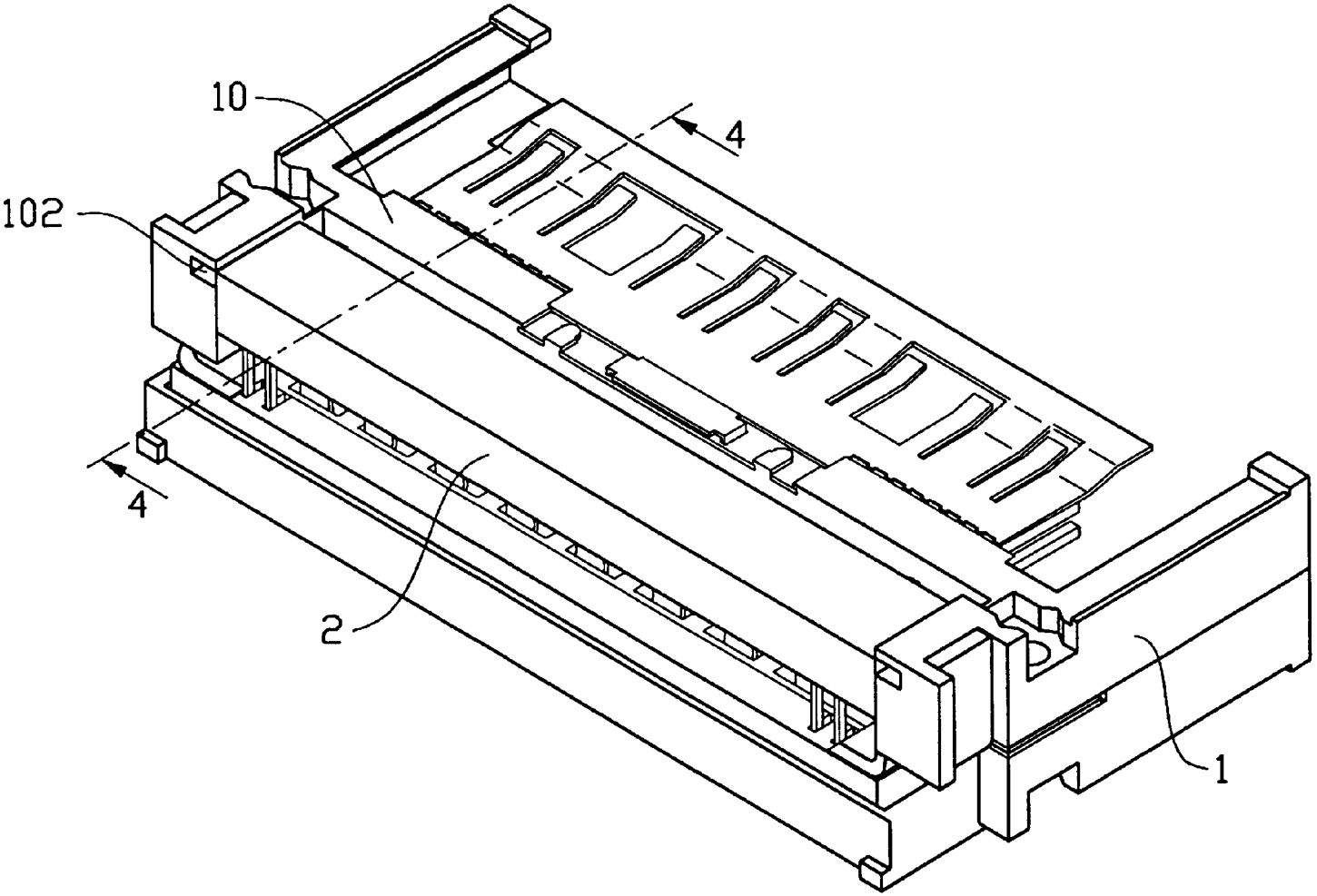
FIG. 3 is an assembled view of FIG. 1.
Figure 4:
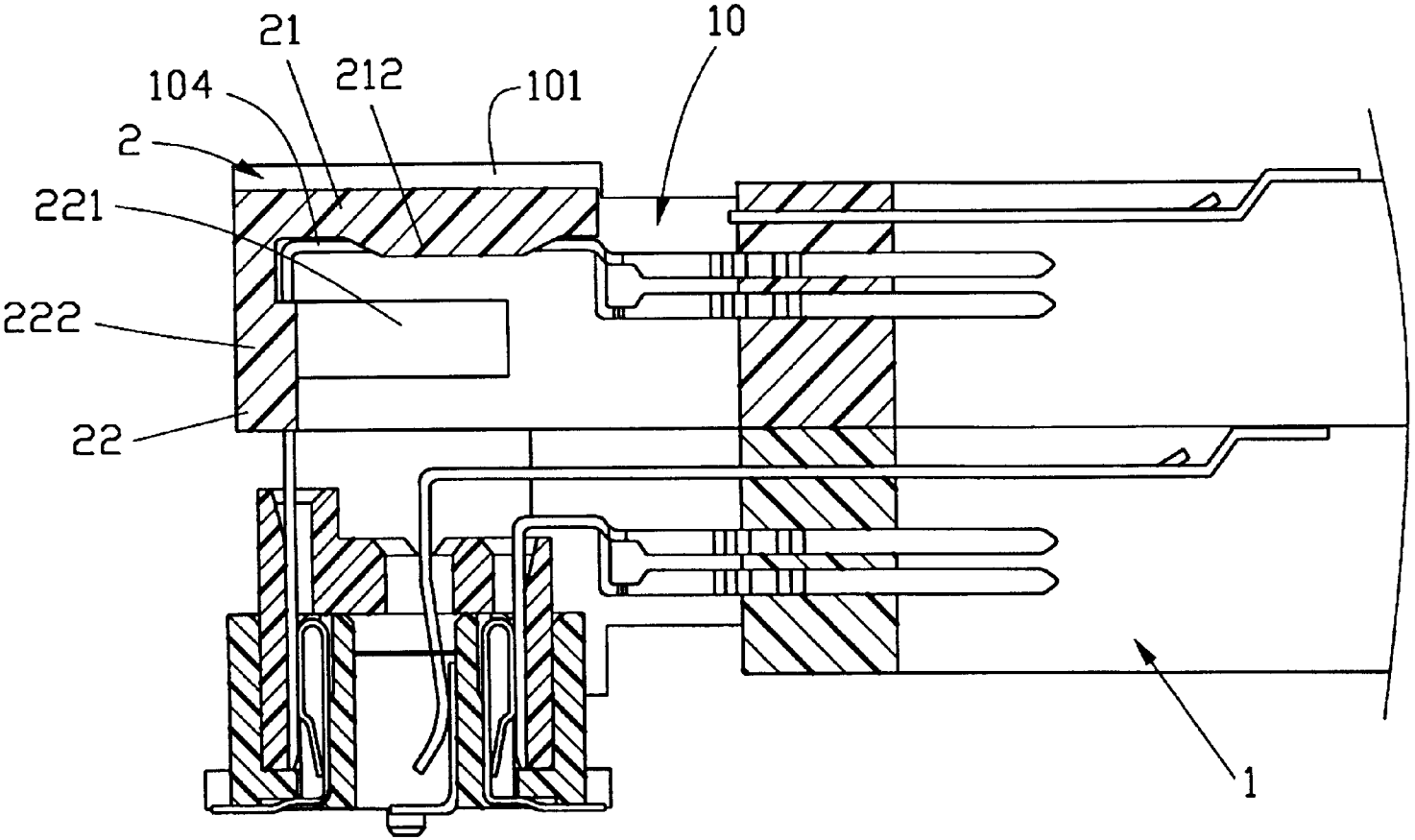
FIG. 4 is a cross-sectional view taken along line 4—4 of FIG. 3.

Referring to FIGS. 3 and 4, in assembly, the spacer 2 is attached to the top header 10 of the main body 1. The inserting blocks 211 of the spacer 2 are inserted into the slots 102 of the header 10 and the latches 221 of the spacer 2 engage with the notches 103 of the top header 10. The passageways 213, 223 of the spacer 2 receive the terminals 104 therein. Thus, the passageways 213 of the spacer 2 can withstand a resistive force exerted on the terminals 104 thereby preventing the terminals 104 from deforming. The passageways 223 of the spacer 2 can assure an accurate alignment of the terminals for facilitating insertion of the terminals into the predetermined holes (not labeled).

It is understood that the invention may be embodied in other specific forms without departing from the spirit of the central characteristics thereof. Thus, the present examples and embodiments are to be considered in all respects as illustrative and not restrictive, and the invention is not to be limited to the details given herein.

What is claimed is:

1. An electrical card connector comprising:

a main body defining a pair of receiving portions and a plurality of terminals between the receiving portions, each receiving portion forming a notch in an inner surface thereof; and a spacer attached to the main body, the spacer including a horizontal board and a vertical board connected to one edge of the horizontal board, a plurality of passageways defined in inner surfaces of the vertical and horizontal boards for receiving the terminals of the main body and a pair of latches extending from opposite ends of the inner surface of the vertical board for engaging with the notches of the receiving portions;

wherein each receiving portion further includes a slot in an inner surface thereof adjacent to and directly above the notch, and wherein the spacer further includes a pair of inserting blocks for being inserted into the slots of the receiving portion;

wherein each board forms a plurality of partitions on the inner surface thereof, the plurality of passageways being defined between the partitions.

* * * * *